United States Patent [19]

Winslow

[11] 3,940,654

[45] Feb. 24, 1976

[54] TRAVELING WAVE TUBE HAVING TAPERED LONGITUDINALLY DIRECTED LOADING CONDUCTORS AT THE OUTPUT

[75] Inventor: Lester M. Winslow, Buffalo Grove, Ill.

[73] Assignee: Varian Associates, Palo Alto, Calif.

[22] Filed: Dec. 16, 1969

[21] Appl. No.: 885,517

[52] U.S. Cl. ..... 315/3.5; 315/3.6; 315/39.3

[51] Int. Cl.[2] ..... H01J 25/34

[58] Field of Search..... 315/3.5, 3.6, 39.3; 333/31 A

[56] References Cited

UNITED STATES PATENTS

| | | | |
|---|---|---|---|
| 2,825,841 | 3/1958 | Convert | 315/3.5 |
| 2,933,637 | 4/1960 | Bruck et al. | 315/3.5 |
| 3,020,439 | 2/1962 | Eichenbaum | 315/3.5 |
| 3,250,946 | 5/1966 | Dechering et al. | 315/3.5 |
| 3,397,339 | 8/1968 | Beaver et al. | 315/3.5 |

*Primary Examiner*—Richard A. Farley
*Assistant Examiner*—S. C. Buczinski
*Attorney, Agent, or Firm*—Stanley Z. Cole; David Roy Pressman; Robert K. Stoddard

[57] ABSTRACT

A traveling wave tube amplifier is disclosed. The amplifier employs a helix derived slow wave circuit arranged for electromagnetic interaction with a stream of electrons for amplifying wave energy applied to the slow wave circuit. A plurality of loading conductors are disposed about the outside surface of the slow wave circuit and extending lengthwise thereof. The conductors are arranged such that the spacing from the conductors to the slow wave circuit decreases toward its downstream end. The conductors are arranged such that they conduct radio frequency currents longitudinally of the slow wave circuit and do not appreciably conduct r.f. current in the direction circumferentially about the axis r.f. power flow on the slow wave circuit. Such loading conductors serve to decrease the phase velocity for wave energy on the circuit over the passband of the circuit. As a result, the interaction efficiency is substantially improved over the passband of the traveling wave tube amplifier. The loading conductors, in a preferred embodiment, are formed by a plurality of conductive channel shaped members with the open side of the channels being disposed facing the slow wave circuit. The channel is tapered in depth such that the conductive vane-shaped side wall members of the channel progressively extend closer to the slow wave circuit taken in the direction toward the downstream end of the circuit.

8 Claims, 7 Drawing Figures

FIG. 1
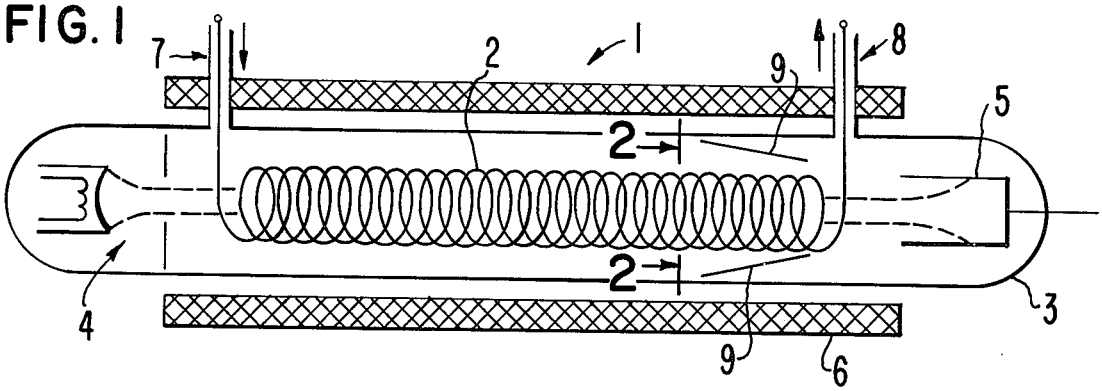
FIG. 2
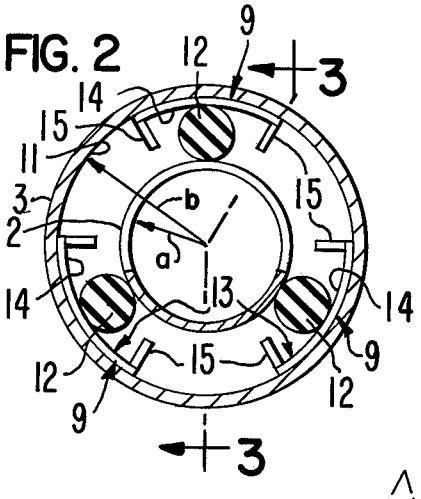
FIG. 3
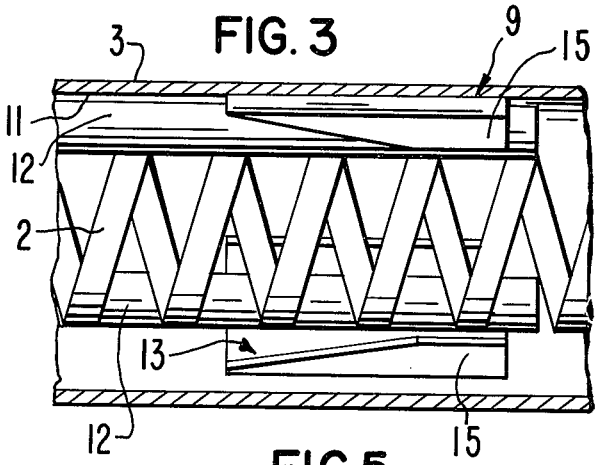
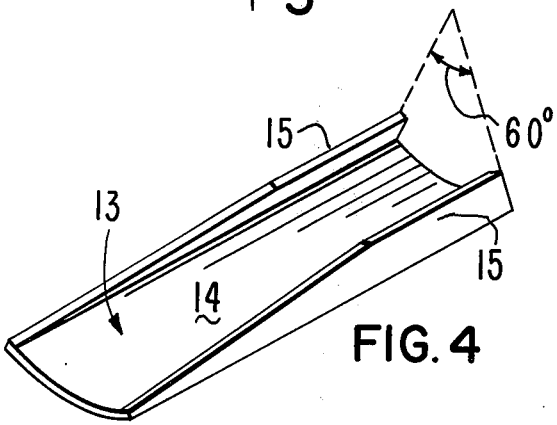
FIG. 4
FIG. 5
PRIOR ART
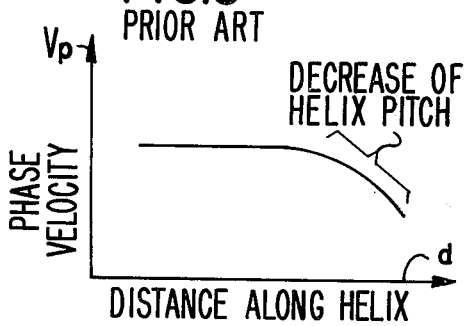
FIG. 6
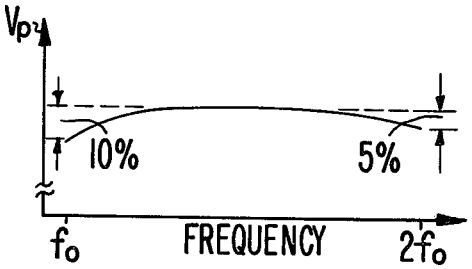
FIG. 7
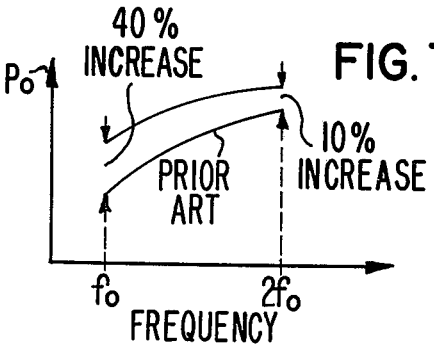
INVENTOR.
LESTER M. WINSLOW
BY Gerald L Moore
ATTORNEY

TRAVELING WAVE TUBE HAVING TAPERED LONGITUDINALLY DIRECTED LOADING CONDUCTORS AT THE OUTPUT

DESCRIPTION OF THE PRIOR ART

Heretofore, helix-type traveling wave tube amplifiers have been constructed employing a helix which was formed with a decreasing pitch near the output end of the helix to decrease the phase velocity of wave energy on the helix for enhanced phase velocity relationships and, therefore, interaction efficiency with the electron beam. While decreasing the pitch of the helix improves the interaction efficiency, it unnecessarily limits the passband of the circuit. Therefore, it is desired to obtain a circuit loading structure which will decrease the phase velocity for wave energy on the circuit without decreasing the passband of the circuit whereby increased efficiency is obtainable over a broader band of frequencies.

It is known from video delay line circuits that the phase velocity of a helix delay line may be decreased by placing a plurality of elongated conductors about the outside of the helix such that the conductors conduct current substantially only in the axial direction along the helix. Such a delay line is described by D. A. Watkins in "Topics in Electromagnetic Theory," pages 62–65, published by Wiley of New York in 1958.

It is also known that band edge oscillations in traveling wave tubes and backward wave oscillators can also be suppressed by means of a plurality of longitudinally directed attenuator vanes disposed about the outside surface of a helix slow wave circuit. Such an attenuator structure is described in copending U.S. Application, 452,279 filed Apr. 20, 1965, now U.S. Pat No. 3,397,339, and assigned to the same assignee as the present invention. However, such attenuator devices do not appreciably improve the efficiency of the circuit.

SUMMARY OF THE PRESENT INVENTION

The principal object of the present invention is the provision of an improved helix derived traveling wave tube amplifier.

One feature of the present invention is the provision, in a helix derived traveling wave tube amplifier, of a conductive loading structure extending along the slow wave circuit and disposed within a region adjacent the downstream half of the slow wave circuit with the radial spacing from the loading structure to the slow wave circuit progressively decreasing toward the downstream end of the circuit to progressively decrease the phase velocity of signal wave energy on the circuit to a greater extent at the lower frequencies than at the upper frequencies of the operating passband of the circuit to increase interaction efficiency of the traveling wave tube amplifier over its operating band.

Another feature of the present invention is the same as the preceding feature wherein the conductive loading structure includes a plurality of elongated conductors circumferentially spaced apart about the outside of the slow wave circuit.

Another feature of the present invention is the same as any one or more of the preceding features wherein the slow wave structure is disposed within a conductive barrel with the elongated loading conductor structure projecting from the inside wall of the barrel toward the slow wave circuit.

Another feature of the present invention is the same as the preceding feature wherein the conductive loading structure is formed by elongated channel-shaped members with the elongated open sides of the channel members facing the slow wave circuit such that the side walls of the channel members form vane-shaped conductive loading members extending toward the slow wave circuit.

Other features and advantages of the present invention will become apparant upon a perusal of the following specification taken in connection with the accompanying drawings wherein:

BRIEF DESCRIPTION OF THE DRAWING

FIG. 1 is a schematic longitudinal sectional view of a traveling wave tube amplifier incorporating features of the present invention, FIG. 2 is an enlarged sectional view of a portion of the structure of FIG. 1 taken along line 2—2 in the direction of the arrows, FIG. 3 is a fragmentary sectional view of the structure of FIG. 2 taken along line 3—3 in the direction of the arrows, FIG. 4 is an enlarged perspective view of one of the loading members depicted in FIGS. 2 and 3, FIG. 5 is a plot of phase velocity versus distance along the helix depicting the prior art method of decreasing the helix pitch at the downstream end of the helix, FIG. 6 is a plot of phase velocity versus frequency depicting the decrease in phase velocity of the slow wave circuit of FIGS. 2 and 3, and FIG. 7 is a plot of power output versus frequency depicting the increase in power output obtained by utilizing the loading members of the present invention.

DESCRIPTION OF THE PREFERRED EMBODIMENTS

Referring now to FIG. 1 there is shown a traveling wave tube amplifier 1 incorporating features of the present invention. The amplifier includes a helical slow wave circuit 2 disposed within an elongated hollow vacuum envelope 3 having an electron gun 4 disposed at one end thereof for forming and projecting a beam of electrons axially through the helix 2 to a beam collector structure 5 disposed at the other end of the envelope 3. A solenoid 6 surrounds the envelope 3 for producing an axially directed beam focusing magnetic field for confining the beam to a desired path and diameter through the helix circuit 2. An input coaxial line 7 forms an input terminal to which microwave energy to be amplified is applied to the helix 2. An output line 8 is connected to the downstream end of the helix 2 for extracting amplified microwave energy from the helix 2.

Microwave signals applied to the helix 2 cumulatively interact with the electron beam to produce an output amplified signal extracted from the tube 1 via output terminal 8. The helix 2 is dimensioned such that the phase velocity of the signal wave energy to be amplified on the helix is in synchronism with the slow space charge waves of the beam within the passband of the helix circuit 2.

A conductive circuit loading structure 9 is disposed surrounding the helix 2 at the downstream end thereof for decreasing the phase velocity of the wave energy on the circuit 2 over the passband for improving the electronic interaction efficiency. The circuit loading structure 9 is more fully described below with regard to

FIGS. 2–4.

Referring now to FIGS. 2–4 the circuit loading structure is more fully described. The vacuum envelope 3 includes a hollow cylindrical bore 11 defining a conductive barrel axially directed of the envelope 3 as of copper. The helix 12 is coaxially disposed within the bore 11 and is supported from the envelope 3 by means of 3 axially directed dielectric insulative rods 12 as of alumina or beryllia and positioned at 120° intervals about the circumference of the helix 2. The circuit loading structure 9 includes 3 conductive channel members 13 as of stainless steel disposed with the open elongated sides of the channels 13 facing the helix 2. The base portion 14 of the channel members each subtend approximately 60° of circumferential arc at the radius of the bore 11 and are curved to conform to the radius of curvature of the bore 11. The upstanding sides of the channel 15 project toward the helix in a radial direction to define a plurality of radial conductive vane members to support the r.f. currents associated with the r.f. wave on the helical circuit 2, such currents being directed in the axial direction along the length of the helix 2. The vanes 15 also permit r.f. current flow in the radial direction but substantially perturb or inhibit r.f. current flowing in the circumferential direction about the outside of the helix 2.

The circuit loading structure 9, formed by the vanes 15, has an axial length which is approximately 20% of the axial length of the helix circuit 2 and the loading structure 9 is disposed substantially at the downstream end of the helix circuit 2. The channel members 13 are tapered in depth from substantially zero depth at the upstream end of the channel to substantially full depth at a point 2/3 along the length of the channel member 13. The side walls 15 of the channel members 13 also tapered in thickness from substantially zero thickness at the shallow end of the channel 13 to full thickness at a point substantially 2/3 of the length of the channel members 13.

In a typical S-band example of the loading structure 9, the channel 13 has a maximum depth of approximately 0.030 inches and is made of 304 stainless 0.005 inches thick. The channel member 13 is approximately 1.500 inches long with a tapered length of 1.00 inches and a full depth length of 0.500 inches. The dielectric support rods 12 are conveniently positioned centrally of the channel members 13.

The ratio of the inside radius $b$ of the bore 11 to the outside radius $a$ of the helix 2 preferably is about 1.65 for the length of the helix 2 upstream of the loading structure 9 such that the phase velocity of the circuit is substantially constant over the passband of the circuit 2. In the S-band example, the length of the helix 2 is approximately 8 inches.

The electrical effect of the conductive vanes 15 is to alter the effective ratio of $b/a$ at the output end of the circuit 2 since $b$ is now the radius to the inside edges of the vanes 15. When the ratio of $b/a$ is reduced to the range of 1.1 to 1.4 the phase velocity of the circuit 2 at the low frequency band edge is substantially reduced and also the phase velocity of the circuit at the upper band edge is reduced to a lesser extent. More specifically, by reference to FIG. 6 it is seen that the phase velocity is reduced by 10% at the low frequency end and approximately 5% at the high frequency end of the passband for a case where the passband is one octave wide. This reduction in the phase velocity $V_p$ of the circuit wave near the output end of the circuit 2 is desirable since at the output end of the circuit, where the kinetic energy of the beam is being converted into microwave energy, there results a decrease in the phase velocity of the slow space charge beam wave. By reducing the phase velocity of the circuit wave in accordance with the decrease in the phase velocity of the space charge beam wave, enhanced interaction efficiency is obtained because synchronism between the circuit wave and the beam wave is maintained at the output end of the circuit 2. This results in a substantial improvement in the efficiency of the amplifier tube 1 as depicted in FIG. 7 where it is seen that the power output is increased by 40% at the low frequency end of the passband and approximately 10% at the high frequency end of the passband as compared with a similar tube not employing the circuit loading structure 9.

In the prior art, as depicted in FIG. 5, the phase velocity of the circuit wave 2 was decreased at the output end of the helix by decreasing the pitch of the helix. While this improves the efficiency of the tube, it substantially decreases the passband over which the improved efficiency is obtained. Therefore, the advantage of the loading structure 9 of the present invention is that the phase velocity $V_p$ is decreased more at the lower band edge than at the upper band edge thereby improving the efficiency of the interaction over the entire passband by maintaining the Pierce synchronism parameter b at its optimum value over the entire passband.

Although the circuit loading structure 9 of the present invention has been depicted as employed with a helix slow wave circuit 2 it may also be used to advantage in other helix derived slow wave circuits such as for example the cross wound helix, ring-and-bar topological equivalent helix, ring-and-loop circuit, folded helix circuit and the bifilar helix.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. In a traveling wave tube amplifier, means forming a helix derived slow wave circuit arranged for electromagnetic interaction with a stream of electrons passable along said slow wave circuit, means at the downstream end of said slow wave circuit for coupling amplified radio frequency output signals from said slow wave circuit, THE IMPROVEMENT COMPRISING, means forming an elongated conductive loading structure disposed outside of said slow wave circuit and extending along said slow wave circuit for conducting radio frequency currents associated with the space outside of said slow wave circuit in a direction along the length of said slow wave circuit, said elongated conductive loading structure including at least a portion thereof which comprises an axially elongated radially projecting vane means for perturbing such radio frequency currents tending to flow circumferentially around the axis of said slow wave circuit, and the radial spacing from said loading structure to said slow wave circuit progressively decreasing toward the downstream end of said slow wave circuit in a region adjacent the downstream half of said slow wave circuit to progressively decrease the phase velocity of signal wave energy on said circuit for frequencies of such energy at the band edges of the operating passband of said circuit to increase the interaction efficiency of the traveling wave tube amplifier over its operating band.

2. The apparatus of claim 1 wherein said conductive loading structure includes a plurality of elongated conductors circumferentially spaced apart about the outside of said slow wave circuit.

3. The apparatus of claim 2 including a conductive barrel structure with said slow wave circuit coaxially disposed within said conductive barrel and said elongated loading conductors mounted on the inner surface of said barrel with said vane means projecting from said barrel toward said slow wave circuit.

4. The apparatus of claim 3 including a plurality of insulative rods disposed about the circumference of said slow wave circuit for insulatively supporting said slow wave circuit from the inside wall of said barrel structure.

5. The apparatus of claim 3 wherein said elongated loading conductors are conductive channel members having elongated open sides facing said slow wave circuit.

6. The apparatus of claim 4 wherein said helix derived slow wave circuit is a helix.

7. The apparatus of claim 5 wherein the conductive side walls of said channel members form vane-shaped conductive loading members extending toward said slow wave circuit.

8. The apparatus of claim 7 including a plurality of insulative rods spaced apart about the outside circumference of said slow wave circuit and extending lengthwise thereof for insulatively supporting said slow wave circuit from said surrounding conductive barrel structure.

* * * * *